United States Patent [19]

Nielsen

[11] 4,449,327

[45] May 22, 1984

[54] TILTING WINDOW, ESPECIALLY FOR INSTALLATION IN AN INCLINED ROOF

[75] Inventor: Elgård Nielsen, Østbirk, Denmark

[73] Assignee: V. Kann Rasmussen Holding A/S, Soborg, Denmark

[21] Appl. No.: 375,275

[22] PCT Filed: Sep. 8, 1981

[86] PCT No.: PCT/DK81/00082

§ 371 Date: Apr. 26, 1982

§ 102(e) Date: Apr. 26, 1982

[87] PCT Pub. No.: WO82/00842

PCT Pub. Date: Mar. 18, 1982

[30] Foreign Application Priority Data

Sep. 10, 1980 [DK] Denmark ..... 3850/80

[51] Int. Cl.[3] ..... E05D 15/00

[52] U.S. Cl. ..... 49/390; 49/252; 49/253

[58] Field of Search ..... 49/390, 251, 252, 253, 49/153

[56] References Cited

U.S. PATENT DOCUMENTS

| | | | |
|---|---|---|---|
| 4,055,024 | 10/1977 | Frank | 49/153 |
| 4,217,732 | 8/1980 | Keichstadt | 49/253 X |

FOREIGN PATENT DOCUMENTS

| | | | |
|---|---|---|---|
| 1708175 | 5/1971 | Fed. Rep. of Germany . | |
| 2425799 | 12/1975 | Fed. Rep. of Germany . | |
| 2845240 | 4/1980 | Fed. Rep. of Germany | 49/252 |
| 1204123 | 8/1959 | France | 49/153 |
| 1233279 | 5/1960 | France . | |
| 1268945 | 6/1961 | France . | |
| 396631 | 9/1977 | Sweden . | |
| 610043 | 3/1979 | Switzerland . | |

*Primary Examiner*—Kenneth Downey

*Attorney, Agent, or Firm*—Lane, Aitken & Kananen

[57] ABSTRACT

In a tilting window having a main frame (1), an intermediate frame (3) top-hinged therein, and a sash (7) pivotally mounted or tilting movement in the intermediate frame, said sash (7) comprises an arresting member (10) which is located in the vicinity of the pivot bearing (6) of the sash and upon closing of the window, which is effected by coordinated tilting of the sash in relation to the intermediate frame and swinging of said intermediate frame in relation to the main frame, engages an associate arresting member (11) on the main frame. After locking together the intermediate frame (3) and the sash (7) at the top, the window will be firmly held in a closed or in a slightly open position. The operation of the window requires only a locking or coupling mechanism at the top of the window.

5 Claims, 3 Drawing Figures

TILTING WINDOW, ESPECIALLY FOR INSTALLATION IN AN INCLINED ROOF

Figure 1:
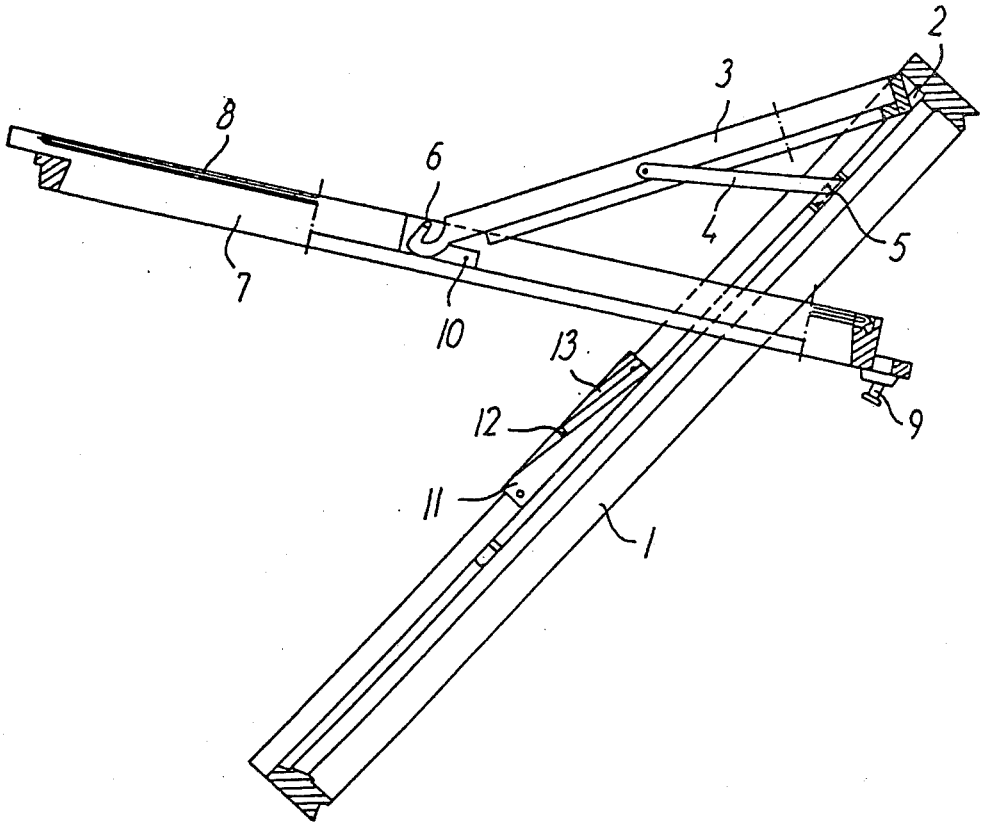

This invention relates to a window particularly designed to be mounted in an inclined roof and comprising, in a known manner, a main frame and an intermediate frame which at its top is hinged to the main frame and is permanently urged in its opening direction, and a pane supporting sash which in the area of its horizontal centre axis is pivotally mounted in the intermediate frame and is adapted to be locked therewith at or in the vicinity of its upper edge, said sash and main frame being provided, at least in one side of the window, with associate arresting means to releasably hold the shash in a desired position.

In a known window of this type the sash comprises at its lower edge a locking member cooperating with the main frame and capable of keeping the window closed against the permanent opening stress exerted on the intermediate frame, and possibly also capable of securing the window in a slightly open position. As long as the intermediate frame and the sash are locked together at their upper edges they act as a single, top-hinged sash, but after this sash has been swung out from the main frame the upper-edge-locking may be released, subsequent to which the pane supporting sash acts as a tilting sash pivoted in the intermediate frame. In this situation the sash can thus be turned more or less a round, for instance with a view to cleaning the outer face of the pane, but it may as well be desired to fasten the sash in one or more intermediate positions, and for this purpose the said arresting means are arranged, which in the known window are constituted by a bolt mounted on a side member of the sash and adapted to engage a striker plate on the adjacent side member of the main frame. With the bolt in engagement the main frame, the intermediate frame and the sash form altogether a stable triangle so that the sash is firmly secured despite possible gust of wind or other influences.

When it is desired to transfer the sash from its closing position to its tilted position, it is thus necessary first to release the sash, at the bottom thereof, from the main frame and subsequently to release it at the top from the intermediate frame, and if it is desired to secure the sash in relation to the intermediate frame, the bolt must further be operated.

The purpose of the invention is to provide a window of the above mentioned type, but designed so that no locking mechanism is needed at the lower edge of the sash. This permits not only a simplification of the structure but also an easier handling, because only manipulations at the top edge of the sash are required.

This is achieved by the window according to the invention in that the arresting means of the sash are located in the area of the tilting axis of said sash and are adapted to automatically engage and disengage the arresting means of the main frame upon the swinging of the sash in the closing direction and in the opening direction, respectively, in relation to the intermediate frame while this intermediate frame is at least almost in its closing position in relation to the main frame.

To open the window in this case it is only required that the locking between the intermediate frame and the upper part of the sash is released and that the sash is subsequently swung as an ordinary tilting sash, until said arresting means have been mutually disengaged. The permanent stress on the intermediate frame then causes it to swing outwardly to a position of equilibrium determined beforehand, and if desired, the sash may thereupon be swung back to its basic position in relation to the intermediate frame and be relocked thereto, or it may be left in a desired angular position in relation to the intermediate frame and maintained in said position, for instance by an enhanced friction in the pivot hinge of the sash.

Also the closing of the window requires manipulations only at the upper edge of the sash. When the sash is in a suitable angle in relation to the intermediate frame it is pulled inwardly towards the main frame, until the intermediate frame is at least almost to abut on this main frame, and when the sash is then swung back towards its closing position said arresting means will reengage, so that the window will be effectively secured in its closing position after the sash has been relocked at its top to the intermediate frame.

An embodiment of the window according to the invention is characterized in that the arresting means of the sash and the main frame include, respectively, a pin parallel to the tilting axis and at least one track open at its lower end and extending approximately parallel to the plane of the window, said track being located so that the pin upon swinging of the sash towards and away from the closing position may slide into and out of the track through its open end.

The location of the pin and the track evidently determines the position in which the locked intermediate frame and sash are secured in relation to the main frame and, accordingly, a particular embodiment of the window according to the invention is characterized in that the arresting means of the main frame comprises a first track to fasten the sash in its closing position and at least one track parallel thereto to fasten the sash in a slightly open position.

It is a characteristic feature of those embodiments too, that the fastening or securing of the sash whether this takes place in the closing position or in a more or less open position dependent on the location of the pin and the track, and also the releasing of the sash is performed by means of a single grip or handle associated with the locking mechanism operative between the top portions of the sash and the intermediate frame, and that locking means between the lower parts of the sash and the main frame may be totally neglected. Moreover, it is a characteristic feature that the arresting pin which may be supported by the sash or possibly by the main frame does not require any separate operation as is for instance the case of the bolt referred to in the foregoing.

According to the invention the arresting means of the sash may alternatively comprise a tongue which is directed towards the upper edge of the sash and in the closing position extends upwardly beneath a stop supported by the main frame, thereby preventing the intermediate frame from moving in relation to the main frame. In this case the function is the same as explained above, but the tongue and the stop may in a particularly simple manner be combined or integrated with the other hinging and sealing elements of the window. Moreover, the risk of wrong engagement between the arresting means and consequent damage to them (particularly in attempting to reclose the sash before the intermediate frame is completely in place) may be avoided by arranging the stop of the main frame to be movable away from its position of engagement against the force of a return spring. In such a case the stop will yield at beginning misengagement so as to prevent damaging influences from arising.

With a view to the above mentioned integration the stop of the main frame may appropriately be constituted by a slide approximately U-shaped in cross-section and slidingly mounted in a guidance within a housing secured on the main frame, said housing further including a tension spring to permanently urging the intermediate frame in its opening direction. Said housing together with the guidance, the slide and the tension spring and possibly also an outer protective mantle for the window may be prefabricated on an industrial basis and later on mounted on the main frame after this has been installed so that work in situ is reduced to a minimum.

Figure 2:
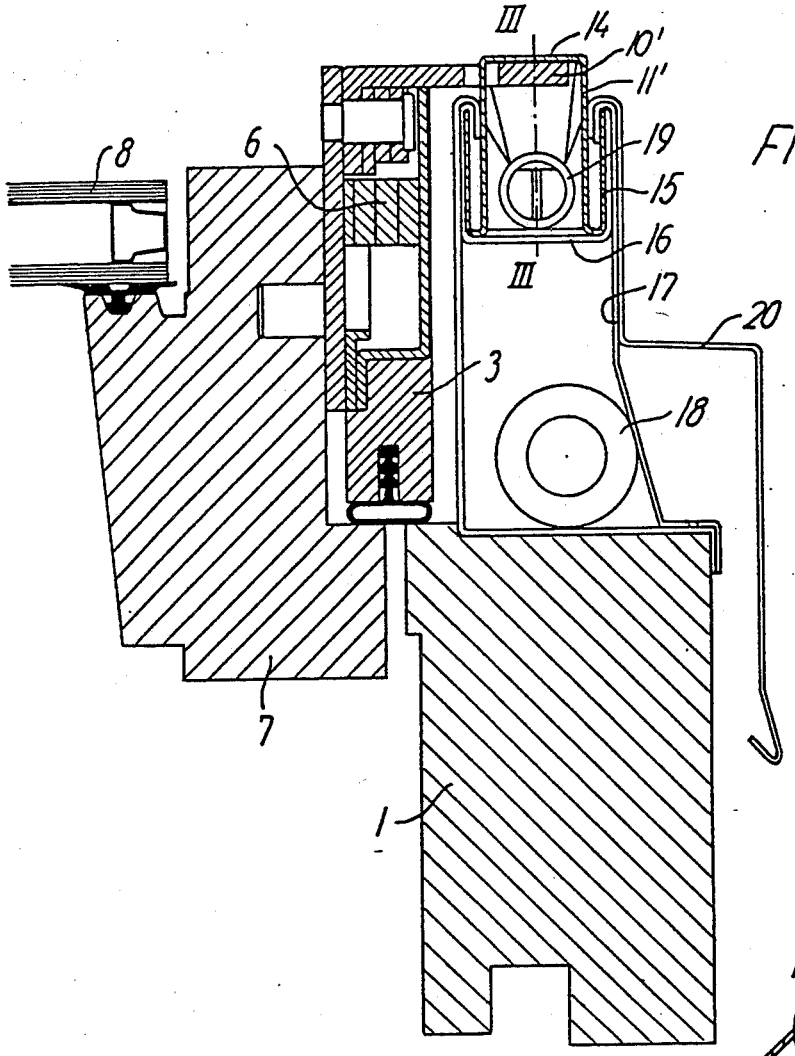
Figure 3:
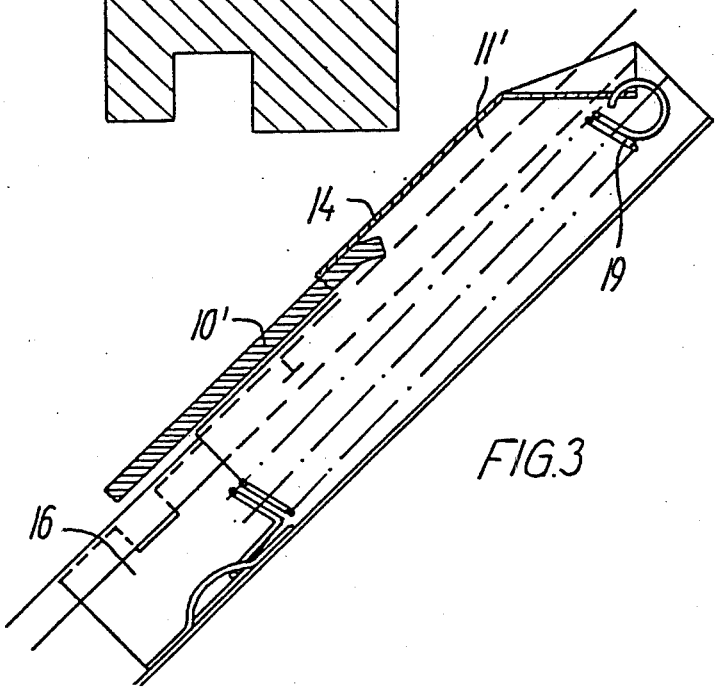

The invention will now be more fully explained with reference to the accompanying drawings, in which FIG. 1 illustrates a first embodiment in schematical side elevation and partially in section showing the sash in open position and released from the intermediate frame, FIG. 2 is a cross-section of the hinge area of the sash in another embodiment of the invention and with the window in its closed position, and FIG. 3 is a section along the line III—III in FIG. 2.

At its top the window main frame 1 shown in FIG. 1 is through a hinge 2 connected with an intermediate frame 3 balanced through a pair of supporting arms 4 pivotally supported by associated slide shoes 5 that are spring-loaded in a direction downwardly along the side member of the main frame.

A sash 7 with one or more panes 8 is mounted in the intermediate frame 3 by means of a pair of coaxial pins 6. At its upper edge said sash may be locked together or coupled to the intermediate frame 3 by means of a mechanism not specifically shown which can be considered as symbolized by the handle 9.

In the vicinity of the pivot pin 6 the side member of the sash 7 is provided with an additional pin 10, and the side member of the main frame 1 has as associate fixture plate 11 with two tracks 12 and 13 having open ends at the outer surface of the main frame.

When the window is to be closed from the position as shown, the sash 7 is swung anti-clockwise in the bearing 6 until it abuts on the intermediate frame 3 which itself is swung inwardly in the hinge 2 into abutment against the main frame 1. During this combined movement care is taken that the arresting pin 10 enters the track 12 so that the window will eventually be kept firmly in its closing position after the sash and the intermediate frame have been locked together at the top. It it is desired to arrest the window in a slightly open position, the pin 10 is guided into the track 13 instead of the track 12.

In the embodiment shown in FIGS. 2 and 3 the sash 7 is mounted at the lower portion of the intermediate frame 3 by means of a tilting hinge 6 that may be of a known type and thus does not have to be explained in detail, said tilting hinge determining a tilting axis at some distance from and outside in relation to the plane of the window. The hinge 6 is combined with an arresting means comprising a tongue 10' that points upwardly against the upper edge of the sash 7, see FIG. 3, and which in the closing position extends upwards beneath a stop or abutment constituted by the web 14 of a slide 11' U-shaped in cross-section and having flanges 15 which are double-folded and slidingly engage a guidance 16 in a housing 17 that is secured on the main frame side member 1 and leaving room for a tension spring 18 serving to load the shoe 5, FIG. 1, downwardly. A second and weaker tension spring 19 urges the slide 11' in the same direction so that this slide may yield upwardly from its position of engagement, if the tongue 10' during the closing movement should abut the edge of the stop 14 instead of sliding upwardly beneath it as intended.

The housing 17 is shown integral with a mantle 20 for exterior weather protection of the casing 1.

I claim:

1. A tilting window arrangement, particularly intended for installation in an inclined roof structure, comprising a main frame including a top member, two spaced lateral members and a bottom member, an intermediate frame including two lateral members which in the closed position of the window extend at least along the upper half of said main frame lateral members, hinge means between the top portions of said main and intermediate frames and defining an axis that is parallel to said main frame top member, means operative to urge said intermediate frame away from its closed position by swinging about said hinge means, a pane supporting sash, pivot means arranged adjacent the horizontal center line of said sash and tiltingly connecting said sash to said intermediate frame lateral members, manually releasable locking means operative between the upper portions of said sash and said intermediate frame, and cooperative arresting means on said sash and said main frame to hold the sash in a predetermined position when said locking means are engaged, the arresting means of the sash being located at a slight distance from the tilting axis defined by said pivot means to be automatically caught by and released from the associated arresting means of said main frame upon tilting of said sash in its closing and opening direction, respectively, in relation to said intermediate frame in the almost closed position thereof.

2. A tilting window arrangement as claimed in claim 1, wherein the arresting means of said sash include a laterally protruding pin extending parallel to said tilting axis, the arresting means of said main frame including at least one track which is open at its lower end to receive said pin upon closing of said sash and which extends upwardly from said open end.

3. A tilting window arrangement as claimed in claim 1, wherein the arresting means of said sash include a laterally protruding pin extending parallel to said tilting axis, the arresting means of said main frame including at least two parallel tracks which are open at their lower ends to receive said pin closing of said sash and which extend upwardly from said open ends, said tracks being located so as to secure said sash in its fully closed and a slightly open position, respectively.

4. A tilting window arrangement as claimed in claim 1, wherein the arresting means of said sash comprises a tongue secured to the sash and having an upwardly extending end portion, the arresting means of said main frame comprising an abutment member carried by the associated main frame lateral member in such a position as to catch said tongue end portion upon closing of said sash.

5. A tilting window arrangement as claimed in claim 4, wherein said abutment member is movable relative to said main frame lateral member between an operative position and an inoperative position and is urged by a return spring towards said operative position.

* * * * *